US011852047B2

(12) United States Patent
Rezkalla et al.

(10) Patent No.: US 11,852,047 B2
(45) Date of Patent: Dec. 26, 2023

(54) ROCKER ARM ASSEMBLY WITH LOST MOTION SPRING CAPSULE

(71) Applicant: Eaton Intelligent Power Limited, Dublin (IE)

(72) Inventors: Ramy Rezkalla, Kalamazoo, MI (US); Andrei Radulescu, Marshall, MI (US); Nicola Andrisani, Cumiana (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/499,336

(22) Filed: Oct. 12, 2021

(65) Prior Publication Data

US 2022/0025788 A1 Jan. 27, 2022

Related U.S. Application Data

(63) Continuation of application No. PCT/EP2020/025172, filed on Apr. 17, 2020.
(Continued)

(51) Int. Cl.
*F01L 1/18* (2006.01)
*F01L 1/24* (2006.01)
(Continued)

(52) U.S. Cl.
CPC ..... *F01L 1/18* (2013.01); *F01L 1/2405* (2013.01); *F01L 1/46* (2013.01); *F01L 13/0005* (2013.01);
(Continued)

(58) Field of Classification Search
CPC ... F01L 1/18; F01L 1/2405; F01L 1/46; F01L 13/0005; F01L 1/06; F01L 2001/467;
(Continued)

(56) References Cited

U.S. PATENT DOCUMENTS 1,995,572 A * 3/1935 Lower ..... F01L 3/08 123/188.9
3,589,346 A * 6/1971 Warren ..... F01L 1/14 123/188.9
(Continued)

FOREIGN PATENT DOCUMENTS

EP 2662540 A1 * 11/2013 ..... F01L 1/185
JP 2010168980 A 8/2010
(Continued)

OTHER PUBLICATIONS

International Search Report and Written Opinion for International Application No. PCT/EP2020/025172 dated Jul. 17, 2020.

*Primary Examiner* — Wesley G Harris
(74) *Attorney, Agent, or Firm* — Baker Botts L.L.P.

(57) ABSTRACT

A valve train arrangement constructed in accordance to one example of the present teachings includes a rocker arm, a deactivating hydraulic lash adjuster (HLA) capsule, a lost motion spring (LMS) capsule and a lever. The rocker arm has a first end and a second end. The second end cooperates with a valve. The HLA capsule cooperates with the first end of the rocker arm. The LMS capsule has a lost motion spring. The LMS capsule is located in a position on the valve train arrangement that is offset from the HLA capsule. The lever is configured between the HLA capsule and the LMS capsule. During cylinder deactivation, load is transferred from the HLA capsule to the lever arm and ultimately to the lost motion spring in the LMS capsule.

16 Claims, 10 Drawing Sheets

Related U.S. Application Data

(60) Provisional application No. 62/835,109, filed on Apr. 17, 2019.

(51) Int. Cl.
*F01L 1/46* (2006.01)
*F01L 13/00* (2006.01)
*F01L 13/06* (2006.01)

(52) U.S. Cl.
CPC ..... *F01L 13/06* (2013.01); *F01L 2001/467* (2013.01); *F01L 2013/001* (2013.01)

(58) Field of Classification Search
CPC . F01L 2013/001; F01L 1/185; F01L 2305/00; F01L 13/06; F01L 2001/186
USPC ..... 123/90.16, 90.39, 90.43
See application file for complete search history.

(56) References Cited

U.S. PATENT DOCUMENTS

| | | | | |
|---|---|---|---|---|
| 5,375,308 | A * | 12/1994 | Harris | B25B 27/26 29/249 |
| 7,121,241 | B1 | 10/2006 | Genise et al. | |
| 8,365,691 | B2 * | 2/2013 | Methley | F01L 1/18 123/90.39 |
| 2003/0111034 | A1 | 6/2003 | Seitz et al. | |

FOREIGN PATENT DOCUMENTS

| | | | | |
|---|---|---|---|---|
| WO | WO-2008012679 | A2 * | 1/2008 | F01L 13/0015 |
| WO | 2018223803 | A1 | 12/2018 | |
| WO | 2020109550 | A1 | 6/2020 | |

* cited by examiner

ROCKER ARM ASSEMBLY WITH LOST MOTION SPRING CAPSULE

CROSS-REFERENCE TO RELATED APPLICATIONS

This application is a continuation of International Application No. PCT/EP2020/025172 filed Apr. 17, 2020, which claims the benefit of U.S. Patent Application No. 62/835,109 filed on Apr. 17, 2019. The disclosure of the above application is incorporated herein by reference.

FIELD

The present disclosure relates generally to a rocker arm assembly for use in a valve train assembly and, more particularly, to a rocker arm assembly having cylinder deactivation and/or engine braking.

BACKGROUND

Some internal combustion engines can utilize rocker arms to transfer rotational motion of cams to linear motion appropriate for opening and closing engine valves. Deactivating rocker arms incorporate mechanisms that allow for selective activation and deactivation of the rocker arm. In a deactivated state, the rocker arm may exhibit lost motion movement. However, conventional valve train carrier assemblies must be often modified to provide a deactivating rocker arm function, which can increase cost and complexity. Accordingly, while conventional valve train carrier assemblies with deactivating rocker arms work for their intended purpose, there remains a need for an improved valve train carrier assembly with deactivating rocker arms.

Furthermore, compression engine brakes can be used as auxiliary brakes in addition to wheel brakes, for example, on relatively large vehicles powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. A hydraulic lash adjuster may also be provided in the valve train assembly to remove any lash or gap that develops between the components in the valve train assembly. In some configurations existing packaging constraints present challenges for incorporating the necessary components.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A valve train arrangement constructed in accordance to one example of the present teachings includes a rocker arm, a deactivating hydraulic lash adjuster (HLA) capsule, a lost motion spring (LMS) capsule and a lever. The rocker arm has a first end and a second end. The second end cooperates with a valve. The HLA capsule cooperates with the first end of the rocker arm. The LMS capsule has a lost motion spring. The LMS capsule is located in a position on the valve train arrangement that is offset from the HLA capsule. The lever is configured between the HLA capsule and the LMS capsule. During cylinder deactivation, load is transferred from the HLA capsule to the lever arm and ultimately to the lost motion spring in the LMS capsule.

According to additional features, the LMS capsule includes a capsule housing that receives the lost motion spring. The LMS capsule further includes a spring cap that bears against the lever arm. The lever arm can include an extension lobe that bears against the spring cap. The lost motion spring can bear against the spring cap. The LMS capsule housing can further receive a lever pin. During movement of the lever arm, the lever arm rotates about the lever pin allowing the spring cap to translate within the capsule housing.

In other features, the lever arm has a first end that is disposed against the HLA capsule and a second end coupled to the capsule housing at the pin. The extension lobe is positioned intermediate the first and second ends of the lever arm. The lever pin can be arranged in a position such that the lost motion spring is intermediate the lever pin and the first end of the rocker arm. The LMS capsule housing can define passages that receive fasteners that are threadably received by a cylinder block that receives the valve train arrangement.

According to still other features, the lever is linear. The lever can have a u-shaped cross-section. The HLA capsule is configured to translate downwardly between 9 mm and 10 mm during cylinder deactivation. In one example, the HLA capsule can be configured to translate downwardly 9.4 mm during cylinder deactivation. The lost motion spring can be configured to translate downwardly between 2.0 mm and 2.5 mm during cylinder deactivation. In one arrangement, the lost motion spring can be configured to translate downwardly about 2.2 mm during cylinder deactivation.

A valve train arrangement constructed in accordance to another example of the present disclosure includes a rocker arm, a deactivating hydraulic lash adjuster (HLA) capsule, a lost motion spring (LMS) capsule and a lever. The rocker arm has a first end and a second end. The second end cooperates with a valve. The HLA capsule cooperates with the first end of the rocker arm. The LMS capsule has a capsule housing that houses a lost motion spring. The lever has a first end that cooperates with the HLA capsule, a second end that is pivotally coupled to the capsule housing at a pivot pin, and an intermediate portion that defines an extension lobe. During cylinder deactivation, load is transferred from the HLA capsule causing the lever arm to pivot about the pivot pin and the lost motion spring to compress in the LMS capsule.

According to other features, the LMS capsule further includes a spring cap that bears against the extension lobe on the lever arm. The lever pin can be arranged in a position such that the lost motion spring is intermediate the lever pin and the first end of the rocker arm. The LMS capsule housing can define passages that receive fasteners that are threadably received by a cylinder block that receives the valve train arrangement.

BRIEF DESCRIPTION OF THE DRAWINGS

The present disclosure will become more fully understood from the detailed description and the accompanying drawings, wherein.

DETAILED DESCRIPTION

Figure 1:
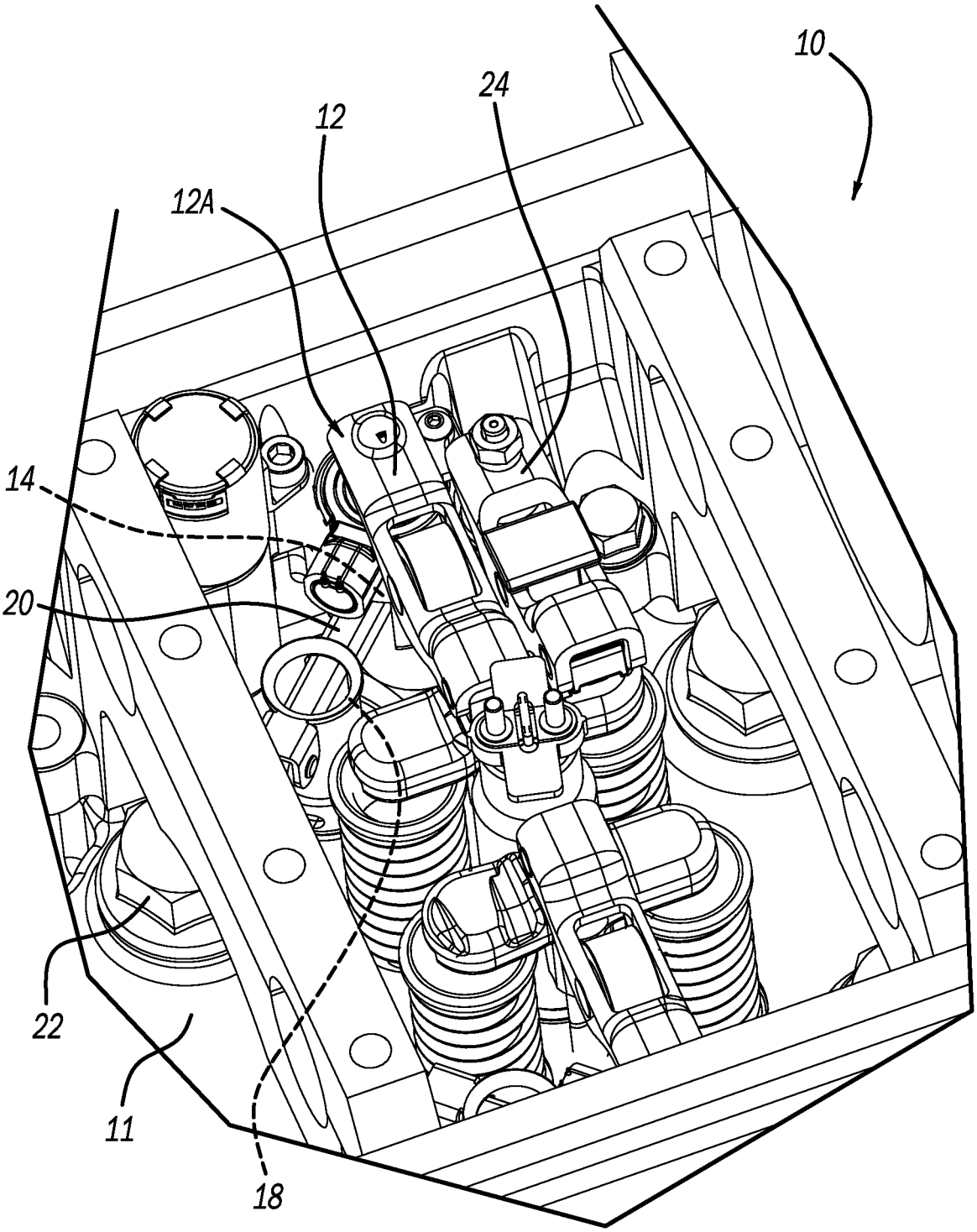
FIG. 1 is a partial top perspective view of a valve train assembly incorporating a rocker arm assembly with a deactivating hydraulic lash adjuster, constructed in accordance to one example of the present disclosure.
Figure 2:
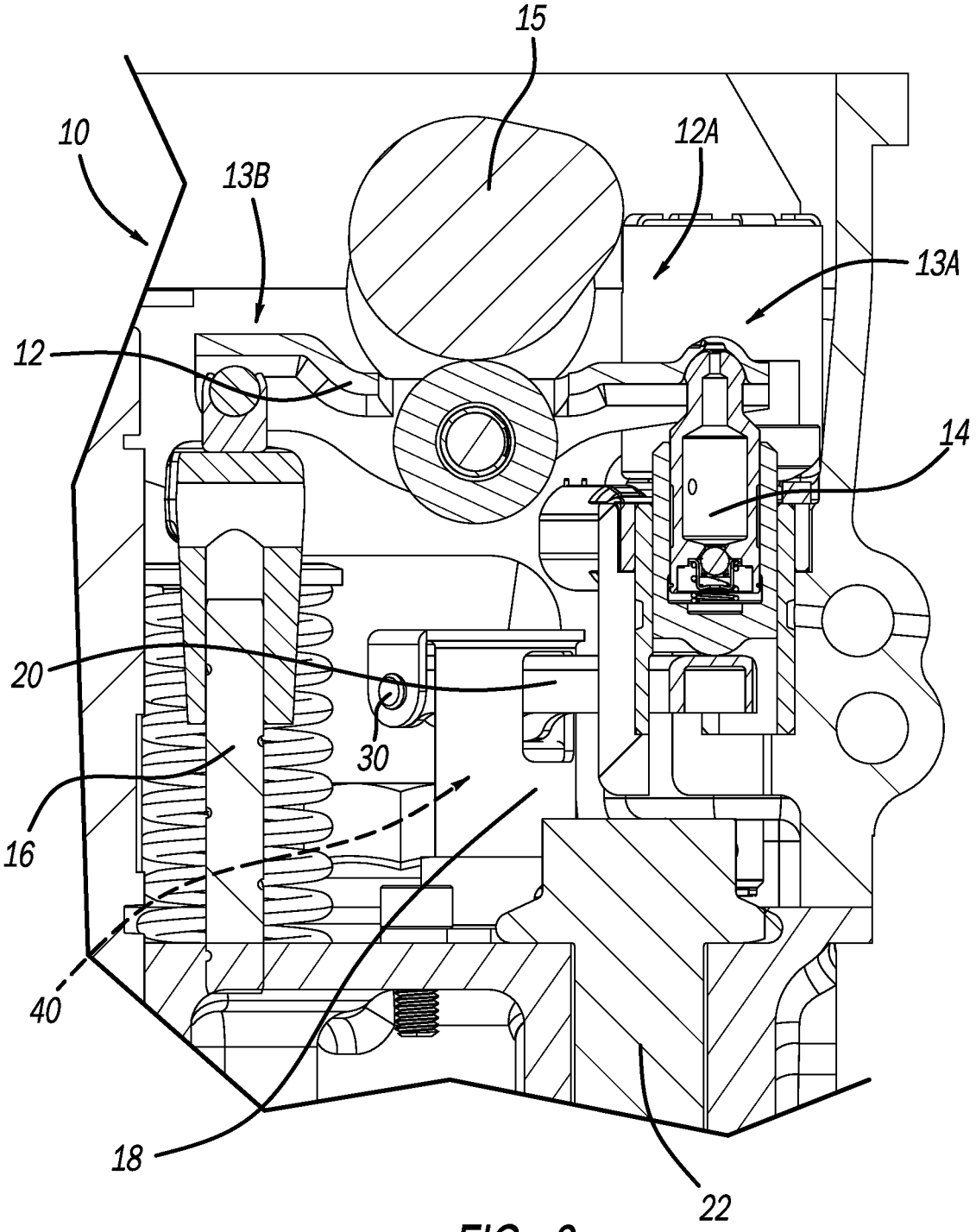
FIG. 2 is a partial side view of the rocker arm assembly of FIG. 1 and further illustrating a lost motion spring (LMS) capsule offset from the deactivating hydraulic lash adjuster with a lever arm according to the present disclosure.
Figure 3:
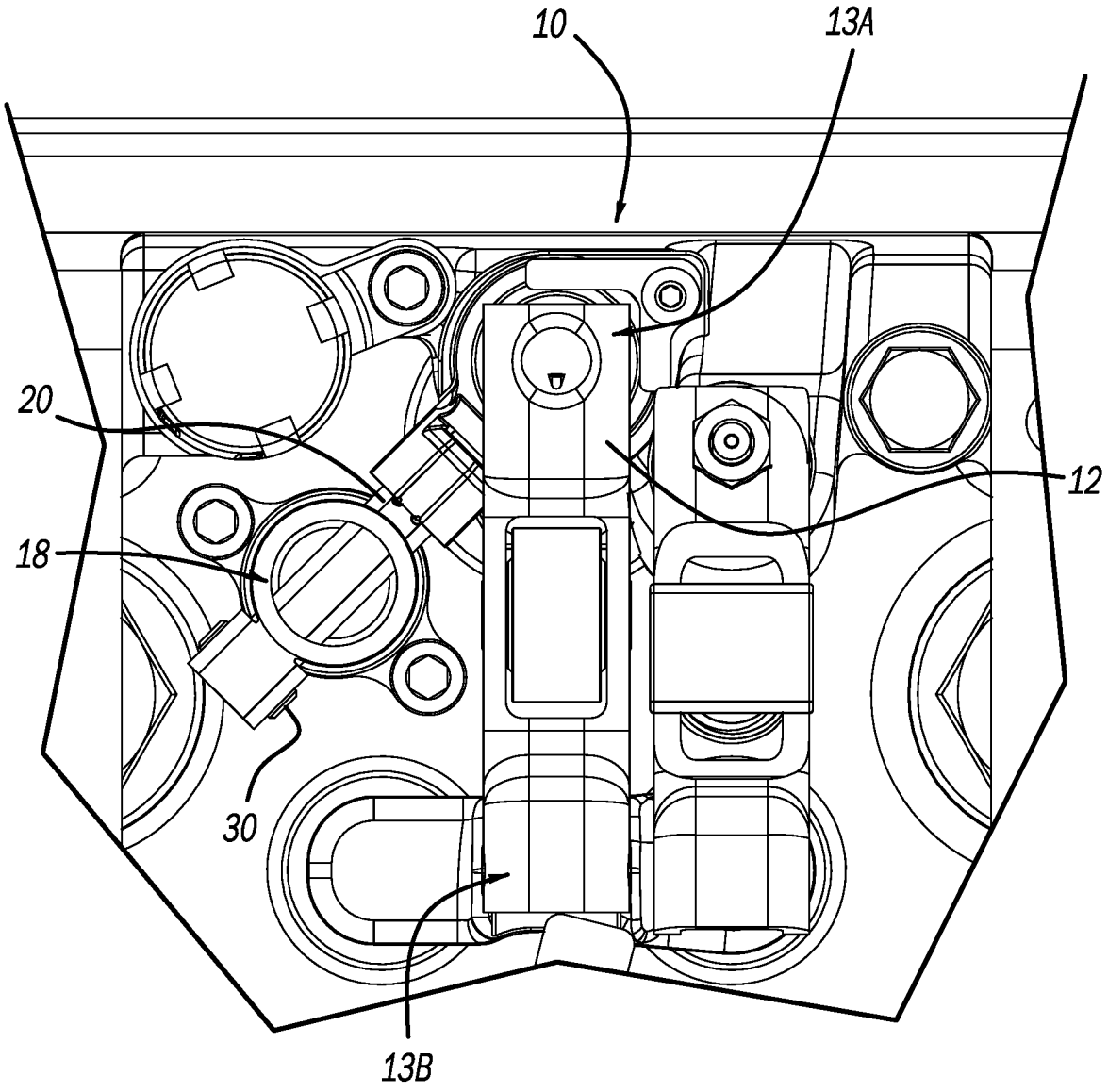
FIG. 3 is a top view of the rocker arm assembly of FIG. 2.

With particular reference to FIGS. 1 and 2, a valve train arrangement 10 is shown positioned on a cylinder block 11. It will be appreciated that the present disclosure for the various features described herein may be used in various other arrangements. In this regard, the features described herein associated with the valve train arrangement 10 can be suitable to a wide variety of applications. The valve train arrangement 10 can generally include a rocker arm assembly 12A and a brake rocker arm assembly 24. As will become appreciated from the following discussion, the rocker arm assembly 12A and brake rocker arm assembly 24 cooperate to selectively open first and second valves 16 and 17.

The rocker arm assembly 12A includes a rocker arm 12 having a deactivating hydraulic lash adjuster (HLA) capsule 14. The rocker arm 12 may be roller finger followers (RFF). An overhead cam lobe 15 (FIG. 2) drives the rocker arm 12. A first end 13A of the rocker arm 12 pivots over the deactivating HLA capsule 14, and a second end 13B of the rocker arm 12 actuates a first valve 16. The deactivating HLA capsule 14 can be selectively deactivated to prevent actuation of the first valve 16. Explained further, when the deactivation HLA capsule 14 is deactivated, the rotational motion of the cam lobe 15 can be absorbed by translation of the capsule 14 and a lever arm 20 (see also FIG. 7). When the HLA capsule 14 is deactivated the motion of the rocker arm 12 is taken up at the first end 13A, not the second end 13B. As a result, the first valve 16 does not translate. A lost motion spring (LMS) capsule 18 is offset relative to the HLA capsule 14 by the lever arm 20. The configuration of the valve train arrangement 10 according to the present teachings provides packaging advantages allowing motion of these components without further re-working of surrounding components.

Figure 4:
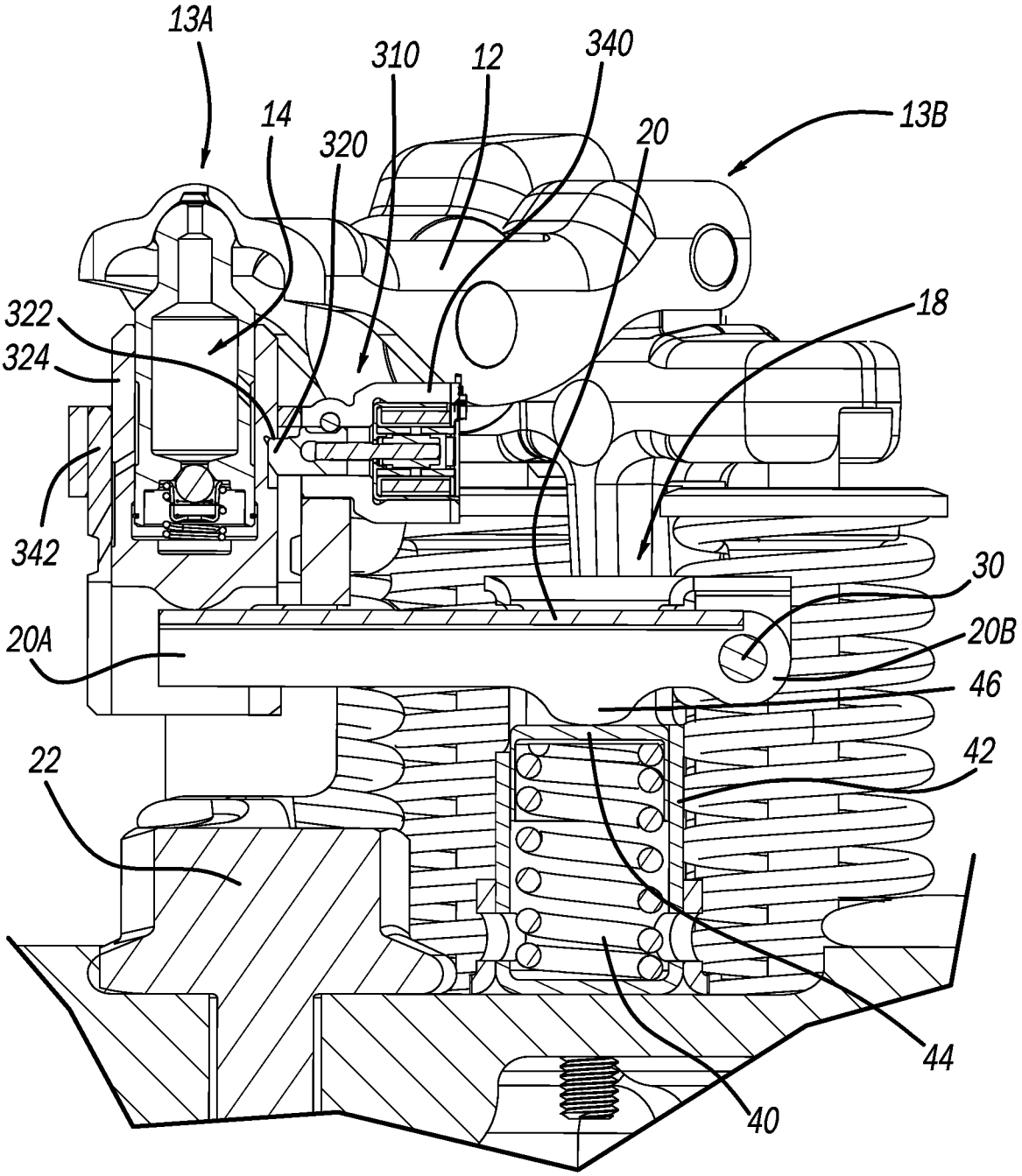
FIG. 4 is a partial sectional view of the lost motion spring (LMS) capsule, lever arm and the deactivating hydraulic lash adjuster of FIG. 2.
Figure 5:
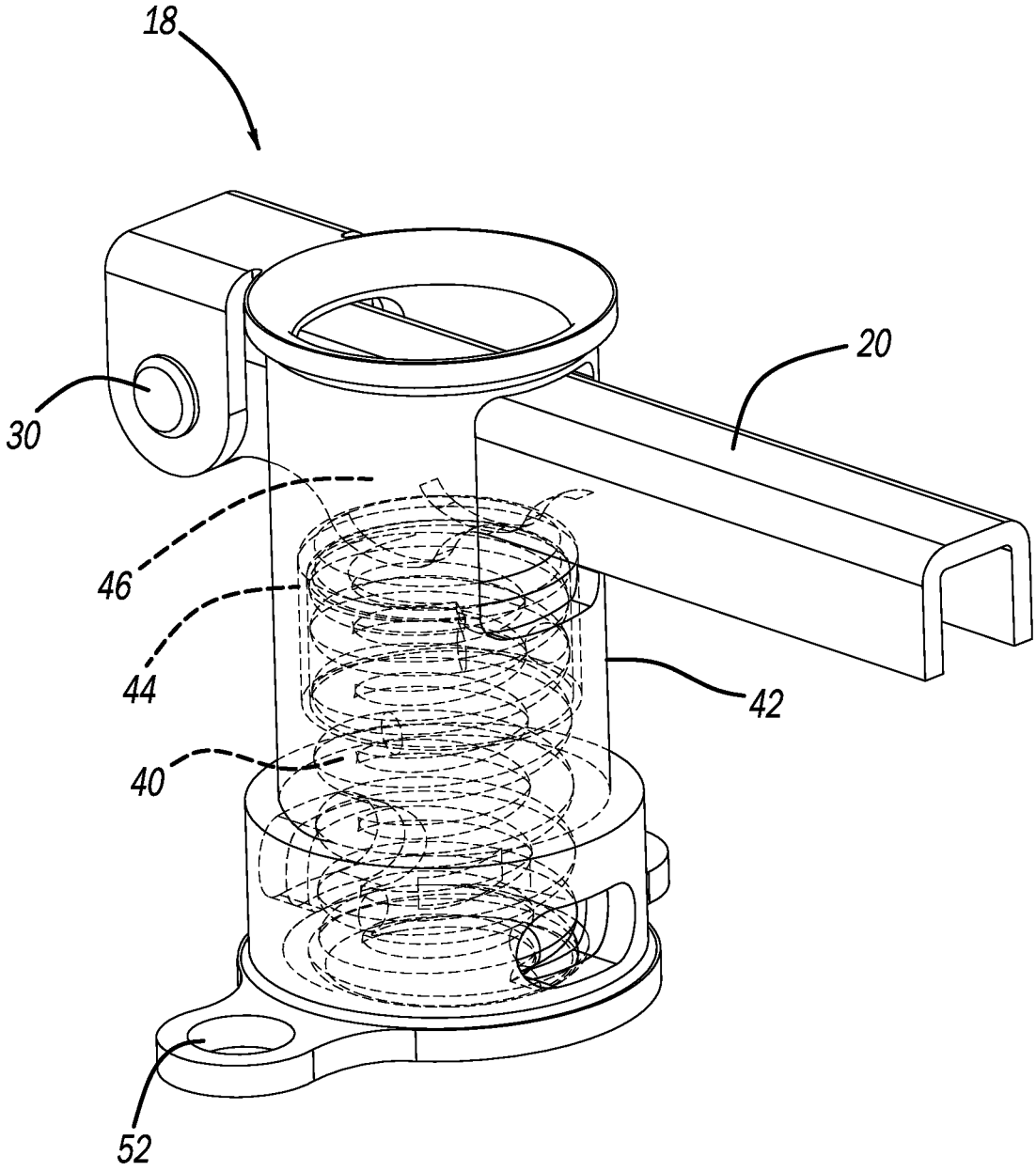
FIG. 5 is perspective view of the LMS capsule of FIG. 2.
Figure 6:
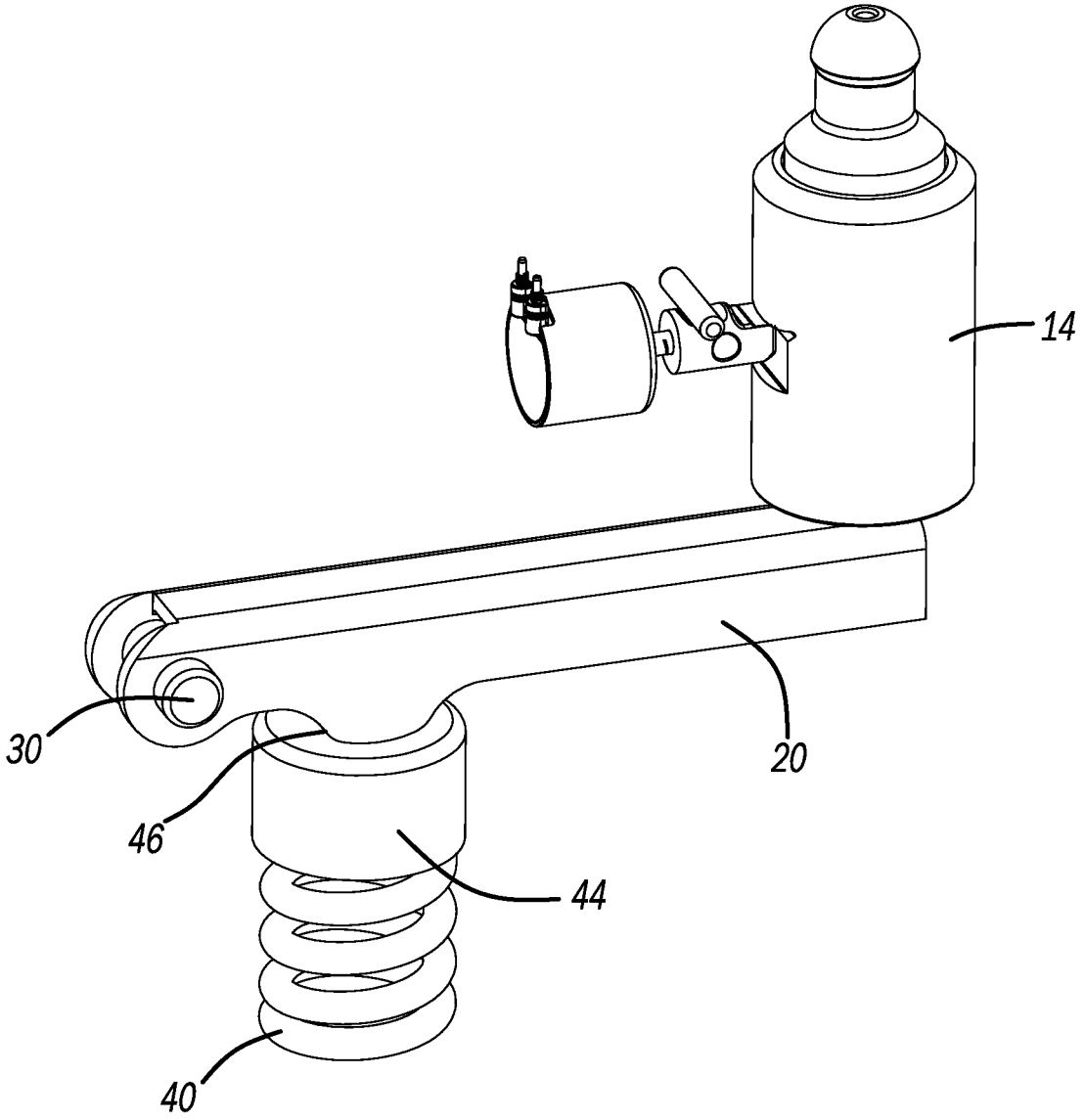
FIG. 6 is a perspective view of the lever arm of FIG. 2 and shown with surrounding components.

As will become appreciated from the following discussion, by locating the lost motion spring capsule 18 offset from the HLA capsule 14 with the lever arm 20, packaging constraints presented by needing to avoid a cylinder head bolt 22 can be solved. Packaging space is no longer an issue with the configuration of the instant application as the cam lift is absorbed by the LMS capsule 18 by translating the motion through the lever arm 20 that pivots around a pivot pin 30 (FIG. 4) within the LMS capsule 18. In other words, the LMS capsule 18 absorbs the motion of the cam 15 during cylinder deactivation by translating the motion through the lever arm 20 that is pivoting around the pivot pin 30 arranged on the LMS capsule 18. In this regard, full cam lift can be absorbed by the LMS capsule 18 in small packaging space. It will be appreciated that while the following discussion is carried out in the context of cylinder deactivation, the principles of the instant application can be adapted for use in other valve train arrangement where lost motion is required, such as other arrangements with limited packaging space.

Figure 9:
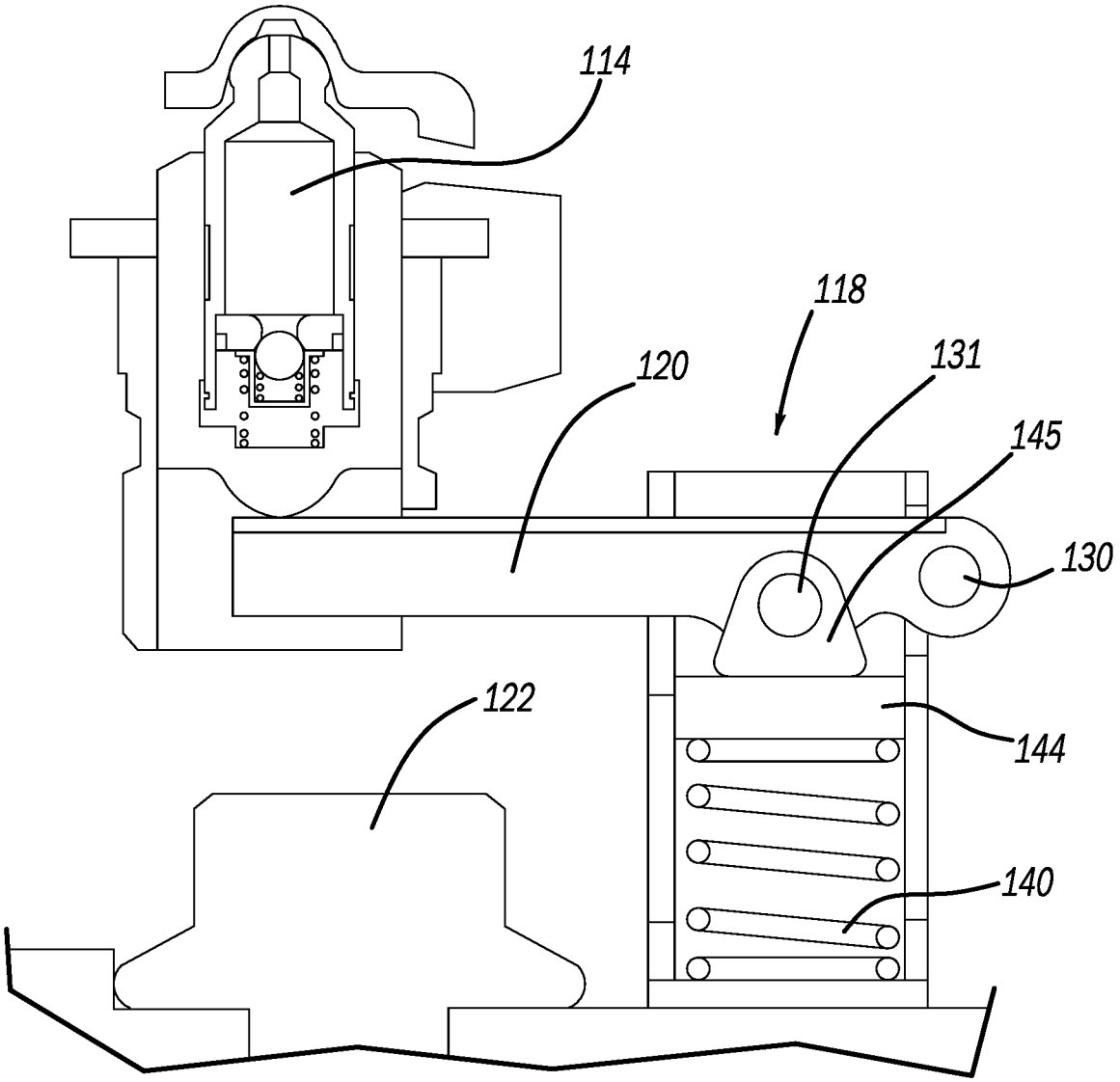
FIG. 9 is a partial sectional view of a lost motion spring capsule, lever arm and deactivating hydraulic lash adjuster constructed in accordance to additional features.

With continued reference to FIGS. 1 and 2 and additional reference to FIGS. 4-7, the LMS capsule 18 will be further described. The LMS capsule 18 includes lost motion spring 40 disposed within a capsule housing 42. The lost motion spring 40 bears against a spring disk or coin or cap 44. The cap 44 is disposed against an extension lobe 46 on the lever arm 20. In other examples, as shown in FIG. 9, the cap 144 can be pivotally coupled to the lever arm 120 through an anchor member 145 at a pivot 131. The remaining components shown in FIG. 9 are similar to those shown in FIG. 4 and indicated in the drawings with reference numerals increased by 100.

Figure 7:
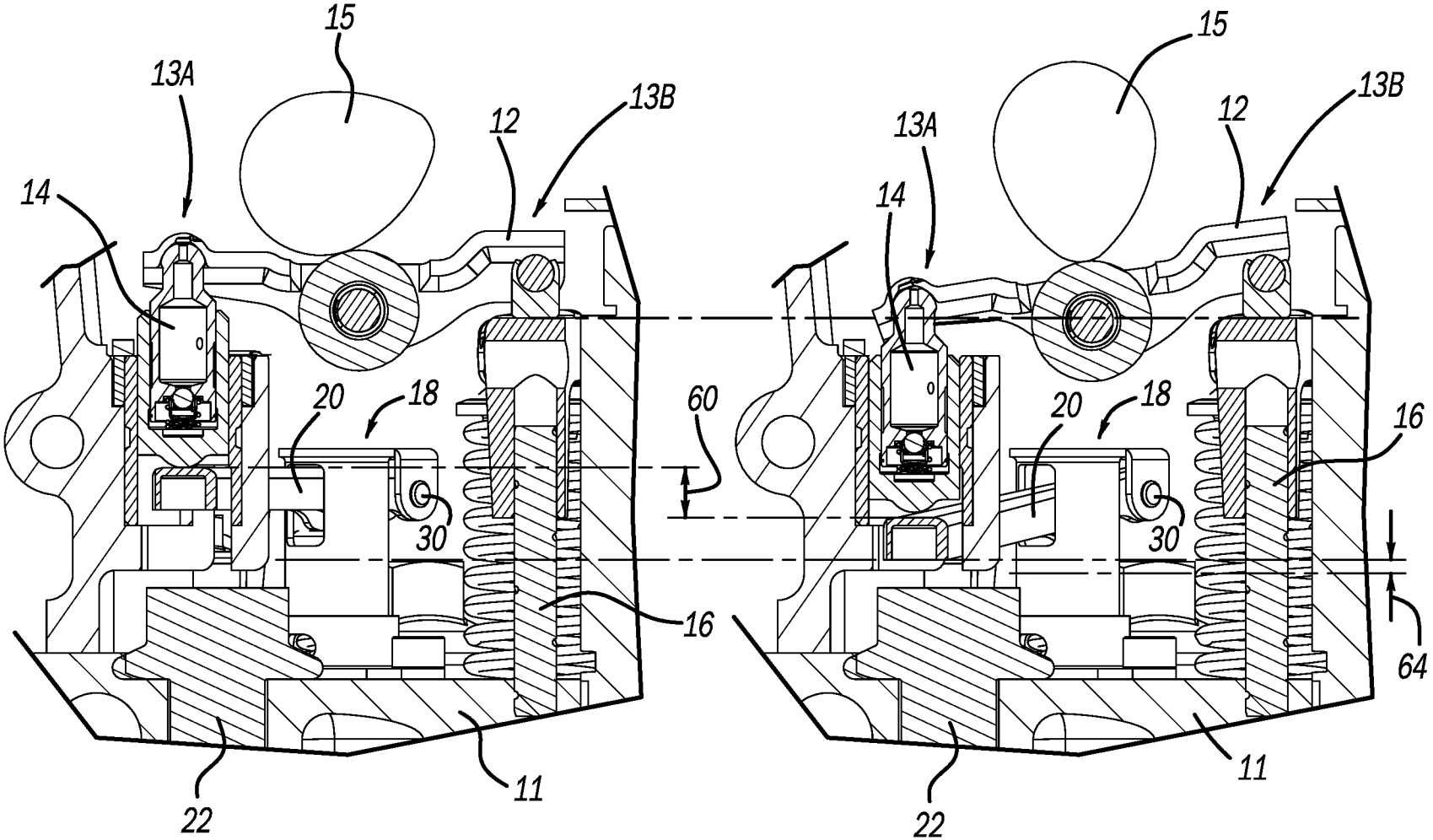
FIG. 7 is a side by side cross sectional illustration showing the rotation of the rocker arm from base circle (left) to cam lobe (right) and resulting pivoting of the lever arm and compression of the LMS capsule.

Returning now to FIG. 4, during movement of the lever arm 20, the lever arm 20 rotates about the lever pin 30 allowing the spring cap 44 to translate within the capsule housing 42 while compressing the lost motion spring 40 (See FIG. 7). Notably the lever pin 30 is arranged in a position such that the spring 40 is intermediate the pin 30 and the first end 13A of the rocker arm 12. The lever arm 20 has a first end 20A and a second end 20B. The first end 20A is disposed against the HLA capsule 14. The second end 20B is coupled to the capsule housing 42 at the pin 30. The extension lobe 46 is arranged on the lever arm 20 at an intermediate position between the first and second ends 20A, 20B. The capsule housing 42 defines passages 52 (FIG. 5) for receiving fasteners that are threadably received by the cylinder block 11. The lever arm 20 is generally linear and can have a u-shaped cross section for improved rigidity.

With particular reference to FIG. 7, as the cam 15 moves from engaging the rocker arm 12 at base circle (left image) to peak lift during cylinder deactivation (right image), load is transferred through the HLA capsule 14, to the lever arm 20 and ultimately to the lost motion spring 40 in the LMS capsule 18. In the example shown, in order to achieve suppression of the motion of the cam 15, the HLA capsule 14 needs to translate downwardly a distance 60. The distance 60 can be between 9 mm and 10 mm. In the example shown, the distance 60 is about 9.38 mm however other distances are contemplated.

The arrangement of the lever arm 20 (and fulcrum at lever pin 30) and LMS capsule 18 provides a solution that satisfactorily absorbs the motion while only requiring the spring 40 to compress a minimal distance 64. The distance 64 can be between 2.0 mm and 2.5 mm. In the example provided the distance 64 is about 2.22 mm however other distances are contemplated. In other advantages, the spring 40 is being compressed in a direction into the cylinder head 11 causing all the load to be directed toward a robust cylinder head 11.

In advantages, the load transfer goes into the cylinder head 11 rather than bolts that support the cam. Additionally, because the lost motion spring stroke can be reduced, the life of the spring 40 can be improved. The overall assembly can have a stiffer construction over prior art examples.

Figure 10:
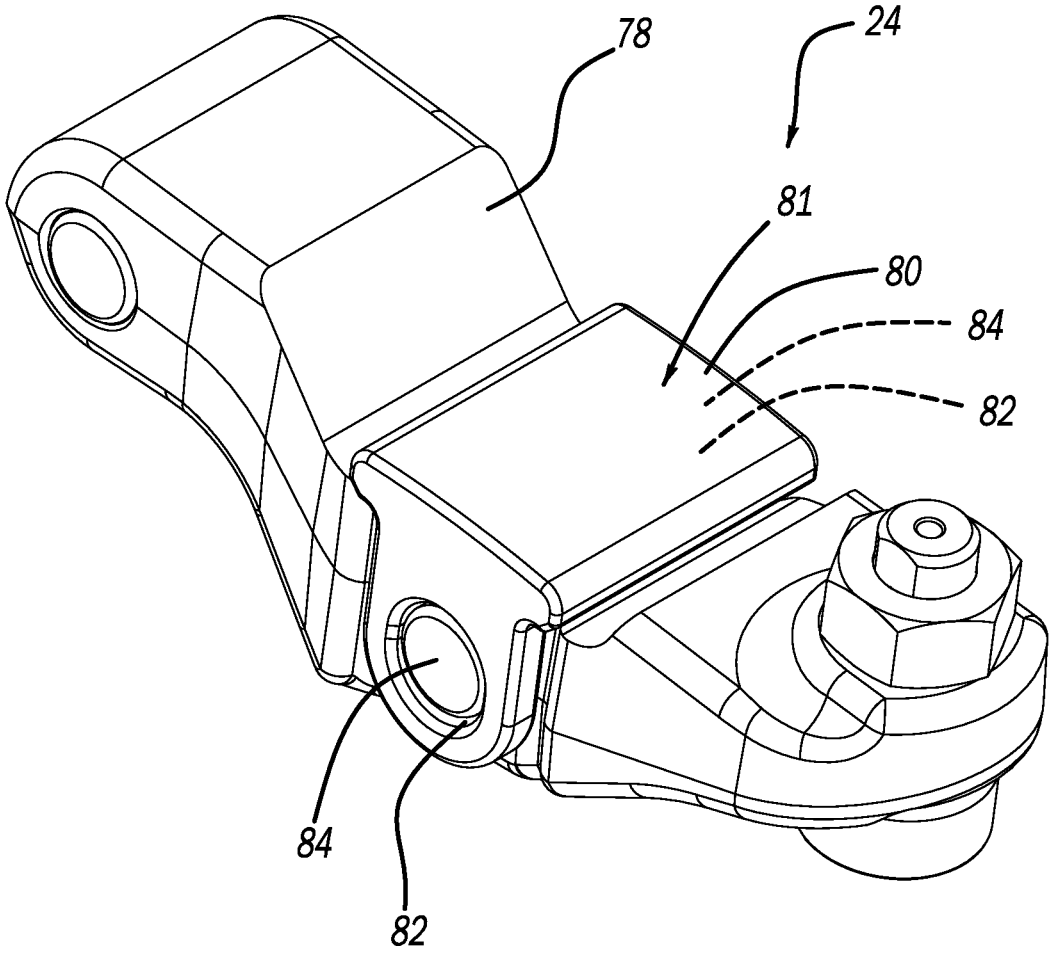
FIG. 10 is a perspective view of a brake rocker arm assembly constructed in accordance to the present disclosure.

Turning now to FIG. 10, additional features of the brake rocker arm assembly 24 will be described. The brake rocker arm assembly 24 comprises a brake rocker arm 78 and an insert 80. The insert 80 can include a diamond-like carbon (DLC) coating 81 to accommodate friction and mitigate stress. The insert 80 can be formed of a hard metal material such as a metallic material used for bearings. The insert 80 can define openings 82 that are coupled to the brake rocker arm 78 at posts 84. In advantages, the insert 80 can be made separately from the brake rocker arm 78. In this regard, the more materials and manufacturing steps used for the insert 80, which are more expensive, can be dedicated only to the insert 80 while the brake rocker arm 78 can be formed of less expensive forged materials.

Figure 8:
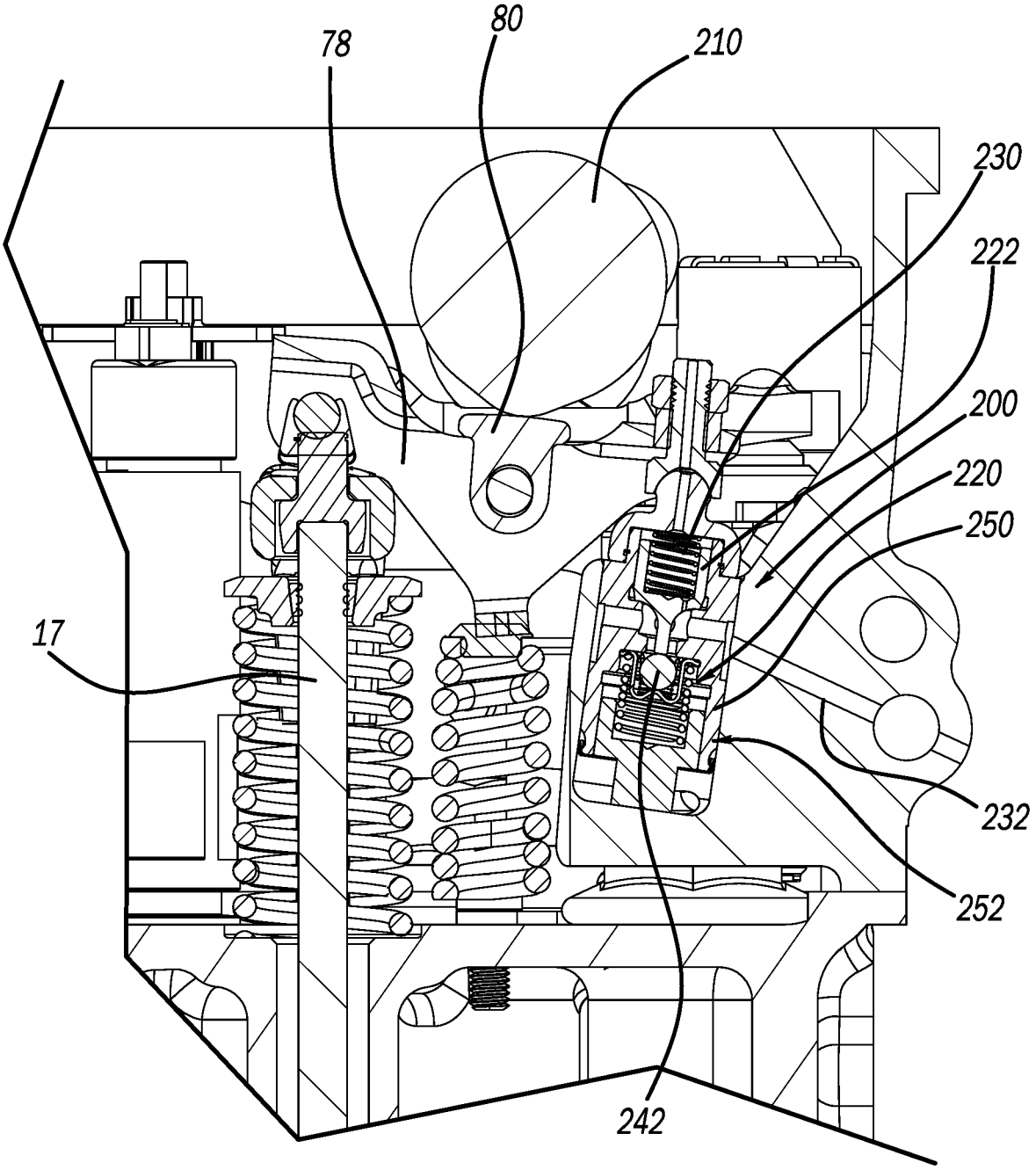
FIG. 8 is a sectional view of the brake arm assembly and brake capsule constructed in accordance to one example of the present disclosure.

With reference now to FIG. 8, the brake rocker arm assembly 24 communicates with a brake capsule 200. The brake capsule 200 can occupy different positions based on a brake function being "on" or "off". In this regard, when the brake function is "on", the brake capsule 200 occupies a position where rotational motion from the cam 210 is transferred through the brake rocker arm 78 and to the second valve 17 is actuated to an open position. When the brake function is "off", the brake capsule 200 occupies a position where rotational motion from the cam 210 is transferred through the brake rocker arm 78 and taken up by the brake capsule 200. In the example shown in FIG. 8, the brake capsule 200 includes a check ball assembly 220 and plunger 222. The plunger 222 is normally biased toward the check ball assembly 220 by a biasing member 230. The arrangement of the brake capsule 200 is such that the plunger 222 is located above the check ball assembly 220.

During operation in braking mode, when oil is delivered through channel 232, the plunger 222 is urged upward against the spring 230, making the brake capsule 200 solid. With the brake capsule 200 solid, the motion of the cam 210 is transferred to the second valve 17. In engine brake "off" mode, the oil pressure in the channel 232 is low allowing the spring 230 to urge the plunger 222 to push the check ball 242 of the check ball assembly 220 off its seat. This allows the body 250 of the brake capsule 200 to move along bore 252. In this regard, it is not just portions of the brake capsule 200 (such as a plunger in prior art examples), it is the entire body 250 of the brake capsule 200.

Returning now to FIG. 4, additional description of the rocker arm assembly 12A will be described. The deactivating HLA capsule 14 cooperates with an electronic latch assembly 310. The electronic latch assembly 310 includes a latch arm 320 that moves between an extended position (FIG. 4) and a withdrawn position. In the extended position, the latch arm 320 engages an opening 322 in a capsule body 324 to preclude the capsule body 324 from translating downwardly. The electronic latch assembly 310 is housed in a latch housing 340 that is coupled to a tube 342 that receives the capsule body 324. The tube 342 can be manufactured as one piece such that all geometries can be easily controlled. Manufacturing processes such as grinding can be carried out efficiently. The latch housing 340 can be pressed around the tube 342 to couple the two pieces together during assembly.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A valve train arrangement comprising:

a rocker arm having a first end and a second end, the second end cooperating with a first valve;

a deactivating hydraulic lash adjuster (HLA) capsule cooperating with the first end of the rocker arm;

a lost motion spring (LMS) capsule having a housing that receives a lost motion spring, the LMS capsule located in a position on the valve train arrangement that is offset from the HLA capsule;

a lever arm configured between the HLA capsule and the LMS capsule wherein during cylinder deactivation, load is transferred from the HLA capsule, to the lever arm and ultimately to the lost motion spring in the LMS capsule, wherein the LMS capsule further includes a spring cap that bears against an extension lobe of the lever arm; and a lever pin received by the LMS capsule housing wherein during movement of the lever arm, the lever arm rotates about the lever pin allowing the spring cap to translate within the LMS capsule housing wherein the lever arm has a first end that is disposed against the HLA capsule and a second end coupled to the LMS capsule housing at the lever pin, wherein the extension lobe is positioned intermediate the first and second ends of the lever arm.

2. The valve train arrangement of claim 1, wherein the lost motion spring bears against the spring cap.

3. The valve train arrangement of claim 2 wherein the LMS capsule housing defines passages that receive fasteners that are threadably received by a cylinder block that receives the valve train arrangement.

4. The valve train arrangement of claim 1 wherein the lever pin is arranged in a position such that the lost motion spring is intermediate the lever pin and the first end of the rocker arm.

5. The valve train arrangement of claim 1 wherein the lever arm is linear.

6. The valve train arrangement of claim 5 wherein the lever arm has a u-shaped cross-section.

7. The valve train arrangement of claim 1 wherein the HLA capsule is configured to translate downwardly between 9 mm and 10 mm during the cylinder deactivation.

8. The valve train arrangement of claim 7 wherein the HLA capsule is configured to translate downwardly 9.4 mm during the cylinder deactivation.

9. The valve train arrangement of claim 1 wherein the lost motion spring is configured to translate downwardly between 2.0 mm and 2.5 mm during the cylinder deactivation.

10. The valve train arrangement of claim 9 wherein the lost motion spring is configured to translate downwardly about 2.2 mm during the cylinder deactivation.

11. A valve train arrangement comprising:

a rocker arm having a first end and a second end, the second end cooperating with a first valve;

a deactivating hydraulic lash adjuster (HLA) capsule cooperating with the first end of the rocker arm;

a lost motion spring (LMS) capsule having a lost motion spring, the LMS capsule located in a position on the valve train arrangement that is offset from the HLA capsule;

a lever configured between the HLA capsule and the LMS capsule wherein during cylinder deactivation, load is transferred from the HLA capsule, to the lever and ultimately to the lost motion spring in the LMS capsule;

a brake rocker arm assembly configured to selectively open a second valve, the brake rocker arm assembly having a brake rocker arm and an insert; and a brake capsule having a check ball assembly and a plunger disposed above the check ball assembly, wherein during braking mode, the plunger is urged upward against a spring making the brake capsule solid such that motion is transferred to the second valve, and when not in the braking mode, a body of the brake capsule translates within a bore of a valve train carrier such that motion is not transferred to the second valve.

12. The valve train arrangement of claim 11 wherein the LMS capsule includes a capsule housing that receives the lost motion spring.

13. The valve train arrangement of claim 12 wherein the LMS capsule further includes a spring cap that bears against the lever.

14. The valve train arrangement of claim 13 wherein the lever includes an extension lobe that bears against the spring cap.

15. The valve train arrangement of claim 14, wherein the lost motion spring bears against the spring cap.

16. A valve train arrangement comprising:

a rocker arm having a first end and a second end, the second end cooperating with a valve;

a deactivating hydraulic lash adjuster (HLA) capsule cooperating with the first end of the rocker arm;

a lost motion spring (LMS) capsule having a capsule housing that houses a lost motion spring, wherein the LMS capsule housing defines passages that receive fasteners that are threadably received by a cylinder block that receives the valve train arrangement; and a lever having a first end that cooperates with the HLA capsule, a second end that is pivotally coupled to the capsule housing at a pivot pin, and an intermediate portion that defines an extension lobe wherein the LMS capsule further includes a spring cap that bears against the extension lobe on the lever, wherein the pivot pin is arranged in a position such that the lost motion spring is intermediate the pivot pin and the first end of the rocker arm;

wherein during cylinder deactivation, load is transferred from the HLA capsule causing the lever to pivot about the pivot pin and the lost motion spring to compress in the LMS capsule.

* * * * *